US007955201B2

(12) United States Patent
Harwath et al.

(10) Patent No.: US 7,955,201 B2
(45) Date of Patent: Jun. 7, 2011

(54) SPIN ELEMENT FOR ARROW OR BOLT

(75) Inventors: Frank A. Harwath, Naperville, IL (US); Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 744 days.

(21) Appl. No.: 11/595,809

(22) Filed: Nov. 10, 2006

(65) Prior Publication Data

US 2008/0113834 A1 May 15, 2008

(51) Int. Cl.
*F42B 6/04* (2006.01)

(52) U.S. Cl. ..... 473/578; 473/585; 473/586

(58) Field of Classification Search ..... 473/578, 473/582, 583, 585, 586
See application file for complete search history.

(56) References Cited

U.S. PATENT DOCUMENTS 3,815,916 A * 6/1974 Meszaros ..... 473/586
4,006,901 A 2/1977 Simo
4,175,749 A 11/1979 Simo
4,203,601 A 5/1980 Simo
4,380,340 A 4/1983 Simo
4,381,866 A 5/1983 Simo
4,529,208 A 7/1985 Simo
4,676,512 A 6/1987 Simo
5,311,855 A * 5/1994 Basik ..... 124/44.5
5,846,147 A * 12/1998 Basik ..... 473/586
5,941,784 A 8/1999 Mizek
6,142,896 A 11/2000 Simo et al.
6,203,457 B1 3/2001 Snook
6,695,727 B1 * 2/2004 Kuhn ..... 473/586
7,025,697 B2 4/2006 Mizek et al.
7,037,222 B2 5/2006 Mizek et al.
7,037,223 B2 * 5/2006 Kuhn ..... 473/583
7,074,143 B2 7/2006 Czemske et al.
7,331,886 B2 * 2/2008 Morris et al. ..... 473/578
2004/0198540 A1 10/2004 Mizek et al.

OTHER PUBLICATIONS

Co-Pending U.S. Appl. No. 11/264,600, filed Nov. 1, 2005.

* cited by examiner

*Primary Examiner* — John Ricci
(74) *Attorney, Agent, or Firm* — Pauley Petersen & Erickson

(57) ABSTRACT

An arrow element, such as an insert and/or sleeve, mounted with respect to a shaft with at least one airflow resistor projecting outward from the insert to impart rotational spin about a longitudinal axis or spin axis arrow during flight, to increase aerodynamic performance and stability of the arrow shaft, and to improve arrow flight accuracy.

25 Claims, 7 Drawing Sheets

SPIN ELEMENT FOR ARROW OR BOLT

BACKGROUND OF THE INVENTION

1. Field of the Invention

This invention relates to an element for an archery arrow or a bolt, having airfoils or other airflow resistors to generate rotation of an arrow shaft about its longitudinal axis, to increase rotation and stability of the arrow shaft, and to improve flight accuracy.

2. Discussion of Related Art

Conventional archery arrows for bows and bolts for crossbows may not provide a significant amount of rotational spin during arrow flight, resulting in poor arrow stability during flight and/or poor arrow flight accuracy.

In an effort to increase rotation of the arrow, some conventional vanes or fletching use helical vanes. However, a decreased clearance between vanes can cause interference with an arrow rest of a bow, particularly during launch. Any interference can cause the arrow to change direction when shot from the bow or to wobble during flight, resulting in decreased accuracy and/or flight distance. Because of a required offset position, arrows having helically oriented archery vanes, such as those positioned at an angle with respect to a longitudinal axis of an arrow shaft, are difficult to manufacture.

Some known vanes have a different surface texture or roughness on each side of the vane, which creates a lift force and imparts rotation along a longitudinal spin axis of the arrow. Vanes with different roughnesses on each side can be positioned generally parallel to the longitudinal axis of the arrow shaft and thus are simpler to manufacture, such as those taught by U.S. Pat. No. 6,142,896, the teachings of which are incorporated into this specification by reference.

A conventional arrowhead that rotates is taught by U.S. Pat. No. 7,037,222, the teachings of which are incorporated into the specification by reference. A rotating arrowhead can also be accomplished with a known winglet or spintab that acts like an airfoil to create lift and rotational forces. There can be additional costs associated with the manufacture of arrowheads with a winglet or a spintab.

There is an apparent need for an arrow element which generates rotation of the arrow shaft about a longitudinal axis to provide increased rotation and increased stability to the arrow shaft, and to improve flight accuracy of the arrow.

It is also apparent that there is a need for an arrow element that is cost effective, easy to produce, simple to install and that enhances aerodynamic flight.

SUMMARY OF THE INVENTION

Arrows or bolts typically include an arrowhead, a shaft, an insert for removably adapting an arrowhead to the shaft, fletching and/or a nock. Arrows are commonly launched from bows that can be either simple or compound while bolts are commonly launched from crossbows. Many arrows and bolts have similar general features but are mostly distinguished by differences in length and weight. As used throughout this specification and the claims, the term arrow is intended to encompass projectiles, including those of the arrow type and the bolt type. As used throughout this specification and the claims, the term element is intended to encompass rotation imparting members, including inserts, sleeves, ferrules, casings, bosses, frames, and the like.

It is one object of this invention to provide an arrow insert, mounted with respect to a shaft, having at least one airflow resistor projecting from the insert, such as outward from the insert, to impart rotational spin about a longitudinal axis or spin axis during flight, to increase rotation and stability of the arrow shaft, and to improve arrow flight accuracy.

It is another object of this invention to provide an arrow insert that is cost effective, easy to produce, and simple to install.

The above and other objects of this invention are accomplished with an insert detachably connected to a shaft. The insert can be positioned at one or more locations between an arrowhead and a nock. According one embodiment of this invention, the insert can be coupled to an arrowhead and/or a knock with a connector having a female receiver engageable with a shaft portion of the insert. The female receiver can form a through bore or a closed bore. The shaft portion may be of a smaller diameter than an outer dimension of a body of the insert. In certain embodiments of this invention, the body diameter and the shaft diameter are about equal.

During flight, aerodynamic forces can act upon the airflow resistor to rotate and thus cause the arrow to spin. The airflow resistor can connect to the body of the insert and can have various shapes and sizes, for example to produce optimal spin or efficient spin during flight. Too much or too little spin can adversely affect flight accuracy and aerodynamic characteristics. A plurality of airflow resistors can effectively create optimal spin or efficient spin. According to a one embodiment of this invention, the airflow resistor is shaped and/or structured as an airfoil. The airfoil may be positioned at an angle with respect to a direction that is parallel or generally parallel to a longitudinal axis of the shaft. The line of contact between the airflow resistor and the body can be straight, linear, nonlinear, curved and/or helical, for example.

In one embodiment of this invention, an inner diameter of the insert at the through bore is less than an outer diameter of a body of the insert and/or of the shaft portion.

During arrow flight, the airflow resistor can create rotational spin by having a drag coefficient greater than that of the shaft, to produce a rotation of the insert and the attached shaft about a spin axis. Generated angular momentum increases rotation and stability of the arrow shaft about the spin axis and improves arrow flight accuracy.

BRIEF DESCRIPTION OF THE DRAWINGS

The drawings show different features of an arrow insert according to different embodiments of this invention, wherein.

DETAILED DESCRIPTION OF THE INVENTION

Figure 1:
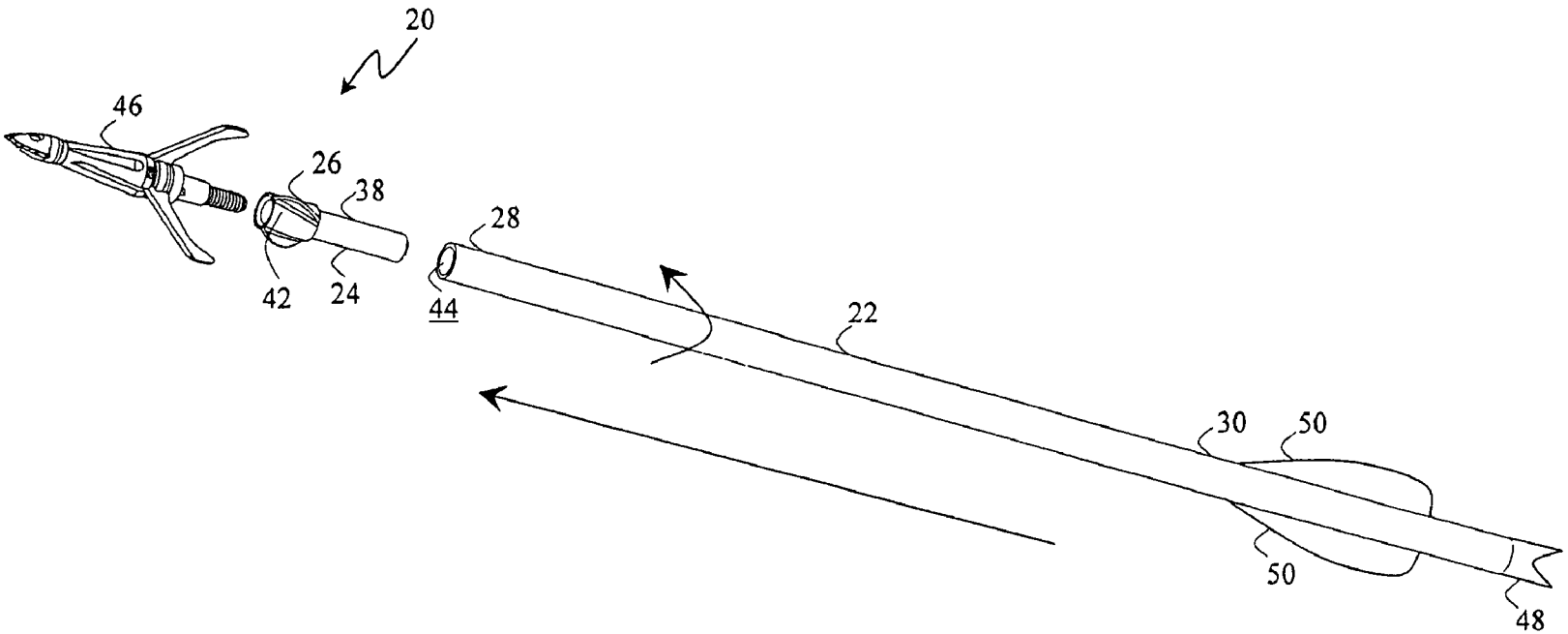
FIG. 1 is a perspective side view of an arrow having an insert positioned near a forward end of an arrow shaft, according to one embodiment of this invention.

FIG. 1 shows an exploded perspective view of an arrow or a bolt with apparatus 20 to generate spin of shaft 22 and insert 24 during arrow flight. Insert 24 comprises at least one airflow resistor 26 that can impart rotational spin about an axis generally parallel to a longitudinal axis or spin axis of the arrow.

Figure 4:
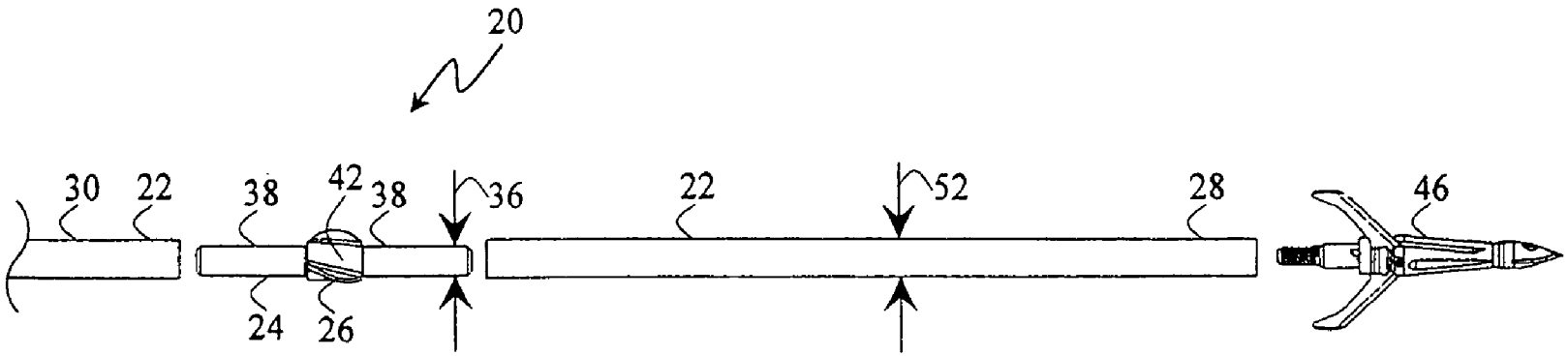
FIG. 4 is a partial side view of an arrow showing an insert positioned between a forward end and a rearward end of a shaft of the arrow, according to one embodiment of this invention.
Figure 7:
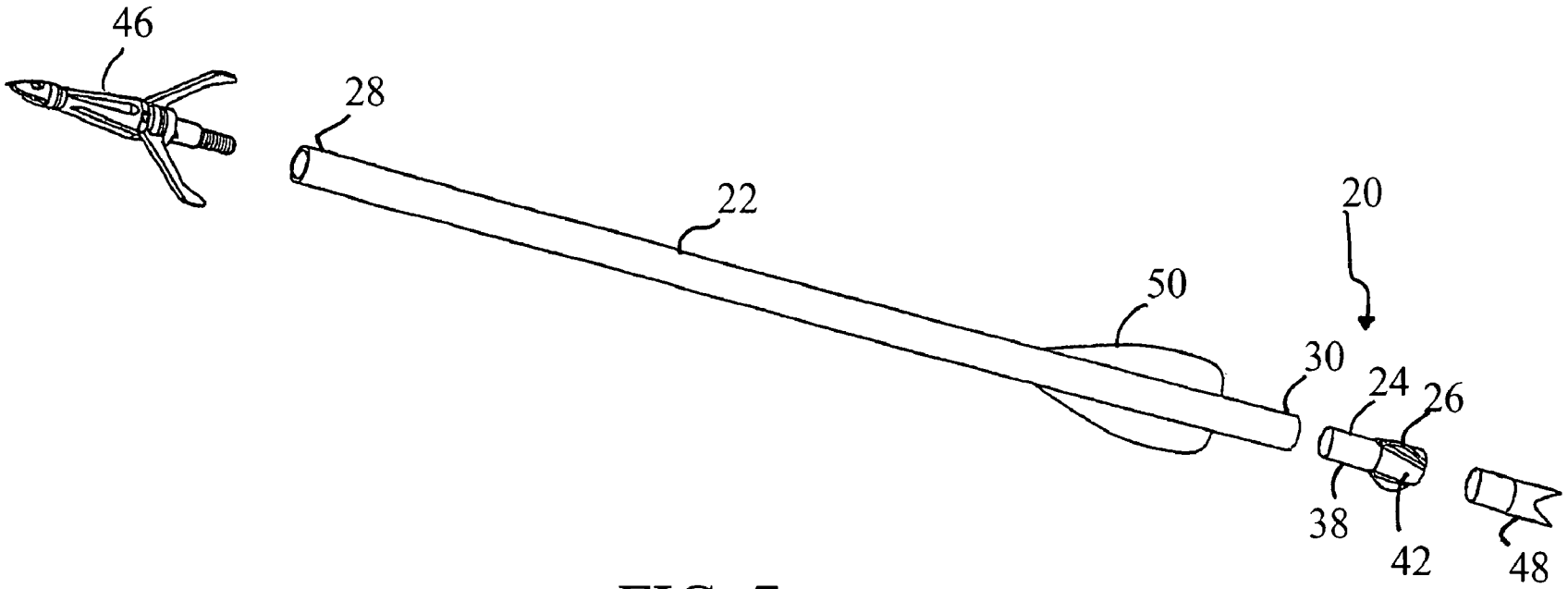
FIG. 7 is a perspective side view of an arrow having an insert positioned near a rearward end of an arrow shaft, according to one embodiment of this invention.

According to certain embodiments of this invention, insert 24 can be mounted or attached in any one or more fixed positions on shaft 22. Insert 24 can be positioned with respect to shaft 22 near forward end 28, shown in FIG. 1, near rearward end 30, shown in FIG. 7, and/or at any position between forward end 28 and rearward end 30. FIG. 4 shows insert 24 positioned between two portions of shaft 22. One or more inserts can be positioned at and/or between arrowhead 46 and nock 48. The various positions of one or more inserts 24 can be selected to take advantage of different airflow or aerodynamic characteristics associated with different types of arrows. For example, arrowhead 46 may interrupt air flow along shaft 22 and/or air turbulence may be caused by other elements positioned near forward end 28 and/or rearward end 30. An arrow with inserts 24 at more than one of the above described positions is possible. Insert 24 can be positioned and/or oriented to minimize possible interference between insert 24 and an arrow rest or a bow.

Figure 2:
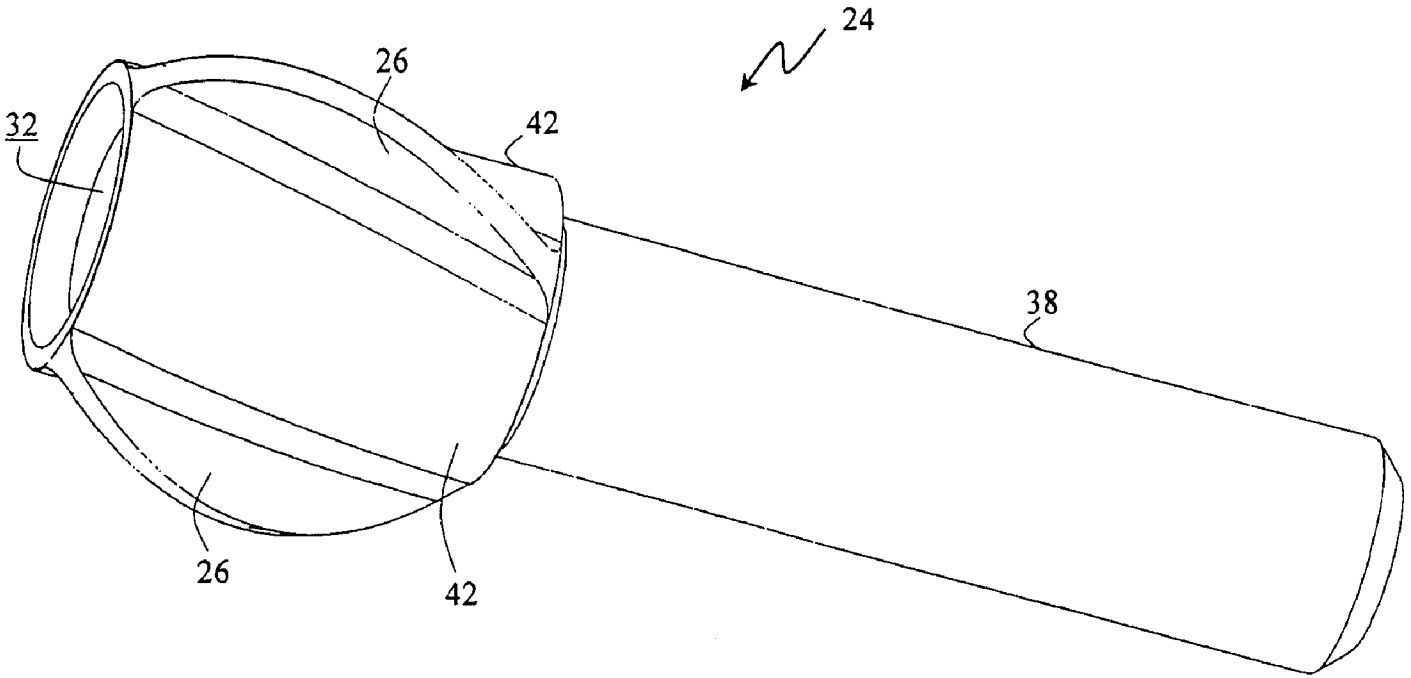
FIG. 2 is a side perspective view of an arrow insert showing airflow resistors and a shaft portion of the insert, according to one embodiment of this invention.

As shown in FIG. 2, insert 24 has body 42 with more than one airflow resistor 26. A plurality of airflow resistors 26 may be attached and/or integrated with body 42. In another embodiment of this invention, three airflow resistors 26 are positioned about a periphery of body 42 at substantially equal spaces. More or less than three airflow resistors 26 can be positioned about or on body 42. Airflow resistor 26 can be attached to, mounted to, or otherwise be connected to or with respect to body 42 with any suitable adhesive, fusion, weld, mechanical joint and/or as an integral construction.

Figure 3:
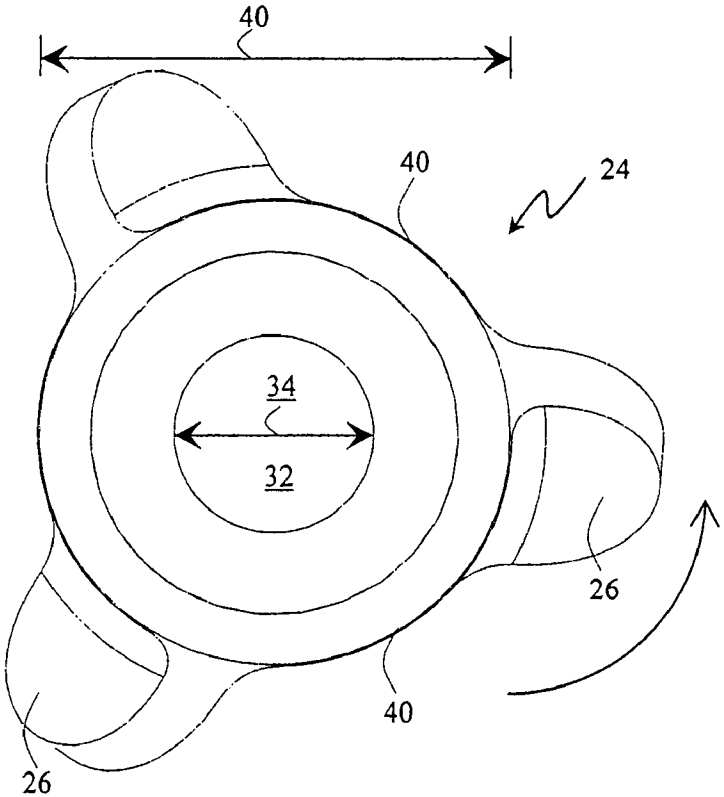
FIG. 3 is a front side view of an insert, according to one embodiment of this invention.

Airflow resistor 26 projects from insert 24, according to some embodiments of this invention, such as shown in FIGS. 2 and 3. During arrow flight, air flows over airflow resistor 26 and thus creates or imparts rotational spin about a longitudinal axis of the arrow, for example creating an overall drag coefficient greater than the drag coefficient of shaft 22. Generated angular momentum can increase rotation and stability of the arrow about a spin axis and thus improve arrow flight accuracy.

Airflow resistor 26 can form an airfoil, designed with any shape to impart the desired rotational force when in motion, such as during flight. At least one side of an outer perimeter of airflow resistor 26 can have a ridge, such as at least partially along an edge, to increase surface area and thus create a pressure difference on one side during flight, to impart a rotational force.

Airflow resistor 26 may be positioned at an angle with respect to a direction that is generally parallel to the longitudinal axis of shaft 22. Airflow resistor 26 can be formed as a fin, a turbine blade, a vane and/or a helical flight. A line of contact between body 42 of insert 24 and airflow resistor 26 can be linear and/or nonlinear. A nonlinear line of contact can provide a helical arrangement, either in a left or a right spiral orientation. The helical arrangement can have any suitable length and/or pitch to impart greater or lesser rotational spin. At certain rotational speeds, the velocity and/or stability of the arrow is negatively affected and the overall frictional drag of the arrow is increased.

A surface of body 42 of insert 24 and airflow resistor 26 may be smooth or have a suitable texture, including but not limited to, ridges, grooves, dimples and/or bumps. A texture of the surface can improve aerodynamics by causing turbulence. In still other embodiments of this invention, airflow resistor 26 can be formed as a channel or a grove.

In one embodiment of this invention, airflow resistor 26 is shaped as an arc or a cord. According to other embodiments of this invention, airflow resistor 26 has a height which is lower at a leading position and a greater height at a trailing position. Airflow resistor 26 can be shaped with a combination of straight edges or curved edges to produce various rotations and/or frictional drag.

According to one embodiment of this invention, a height of airflow resistor 26 is about one-third of a shaft outer diameter 52. In other embodiments of this invention, a protrusion or kicker element can further impart rotational force. A kicker element can add additional mass or weight to the arrow.

In one embodiment of this invention, insert 24 is detachably connected with respect to shaft 22. Any suitable detachable connection, such as a threaded connection, a tolerance fit, an interference fit, an adhesive, a key, a keyway, a set screw, and any other suitable connector can be used to fix a position of insert 24 with respect to shaft 22, arrowhead 46 and/or nock 48. In other embodiments of this invention, insert 24 can be permanently connected to shaft 22, such as by welding, with a nonremovable adhesive, and the like.

It is also possible to integrate shaft 22 and insert 24. Surface grooves formed from mating surfaces of insert 24 and shaft 22 can provide additional surface areas and thus a stronger connection.

According to other embodiments of this invention, body 42 can be formed as a collar, a sleeve and/or a ferrule, adaptable to a fixed position on or along shaft 22. In one embodiment of this invention as shown in FIG. 5, body 42 can be fabricated from a flexible and/or resilient material, such as an elastomeric material, and can have an aperture along a longitudinal axis with an inner diameter slightly less than that of shaft outer diameter 52, to provide an interference fit or friction fit with an element, such as an outer surface of shaft 22.

For example, body 42 can be stretched, positioned and then mounted on shaft 22. In certain embodiments of this invention, the sleeve or collar structure of body 42 can be turned inside out and then rolled onto shaft 22. A flexible body 42 can be mounted on or attached to shaft 22 in any other suitable manner.

Body 42 formed from elastomer may have good target penetration because the material can flex and/or bend when contacting structure or another path obstacle within a target. The hardness and/or stiffness of the flexible and/or resilient material can be varied to provide different structural strengths of body 42 and/or airflow resistor 26.

Figure 5:
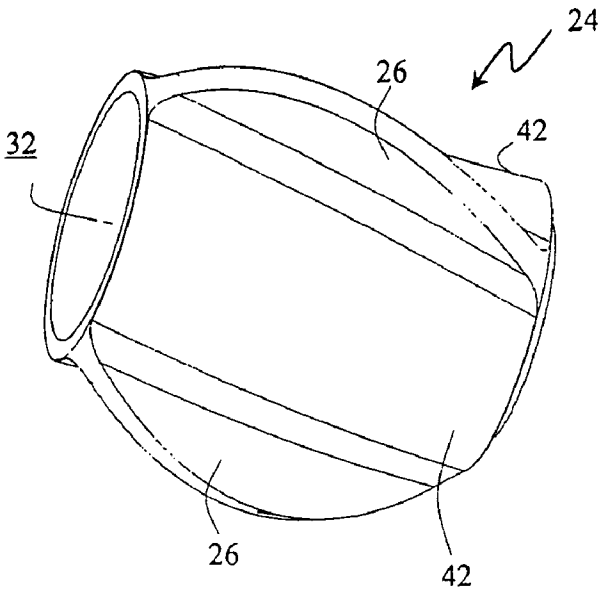
FIG. 5 is a side perspective view of an arrow element, according to one embodiment of this invention.
Figure 6:
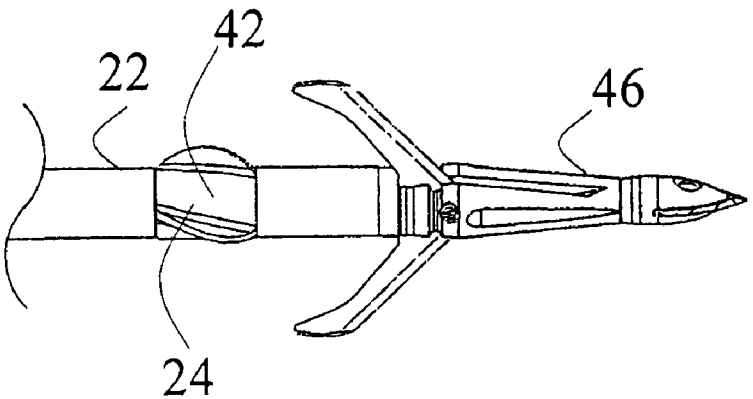
FIG. 6 is a partial side view showing an assembled arrow with an element, according to one embodiment of this invention.

In one embodiment of this invention as shown in FIG. 5 or FIG. 6, body 42 can be fabricated from a shrinkable material and can have an aperture along a longitudinal axis with a diameter slightly greater than that of shaft outer diameter 52. An interference fit or friction fit can form when body 42 shrinks, tightens, tensions and/or conforms over and/or around shaft 22. Shrinkable material can be generally activated by applying heat, such as with a heat gun, a hair dryer, a torch, hot water, boiling water and any other suitable heat transfer medium or mechanism Suitable shrinkable material may include, for example PVC films.

In certain embodiments of this invention, insert 24 has at least one female receiver 32 that accepts arrowhead 46 and/or nock 48. Female receiver 32 is adaptable to a forward or a rearward orientation, depending upon a desired position relative to the arrow. Female receiver 32 may form a closed bore that does or does not extend a complete length of insert 24.

Female receiver 32 can form a through bore. A closed bore may offer additional structural strength. Female receiver 32 can be threaded or adapted to the connections detailed above.

As shown between FIGS. 3 and 4, insert 24 has inner diameter 34, such as at the through bore, that is less than outer diameter 36 of shaft portion 38. Varying diameters of shaft portion 38 and the bore of female receiver 32 can provide proper balance and reduced material needs.

In another embodiment of this invention, at least one shaft portion 38 of insert 24 each extends in a forward or a rearward orientation, such as shown in FIG. 4. Shaft portion 38 can be positioned at different orientations to allow insert 24 to be positioned at any suitable location.

In one embodiment of this invention, shaft portion outer diameter 36 is less than body outer diameter 40. A smaller shaft portion outer diameter 36 allows insertion into shaft receiver 44 of shaft 22. A joint formed by shaft portion 38 of insert 24 and shaft receiver 44 of shaft 22 may be secured with any suitable adhesive.

A length of body 42 can be about two times shaft diameter 52, in certain embodiments of this invention. In other embodiments of this invention, the length of body 42 is between a fraction of the shaft diameter 52 and a multiple of shaft diameter 52. Body 42 can be as short as possible to impart rotational spin yet not significantly depart from geometries of conventional arrows.

In certain embodiments of this invention, body outer diameter 40 is about equal to shaft outer diameter 52 which can provide a smother transition between pieces and thus better aerodynamics and/or flight characteristics. In other embodiments of this invention, body outer diameter 40 is greater than or less than shaft outer diameter 52. Body outer diameter may be constant or may vary over or along a length of body 42.

Insert 24 may be fabricated from any suitable material including wood, plastic, metal, elastomer, composite and/or ceramic. Selection of materials depends on factors such as cost of materials, cost of fabrication, physical characteristics including strength, weight, impact resistance and the like. A suitable material can withstand forces experienced during arrow use and resuse.

Specifically suitable metals include aluminum, brass, carbon steel, chrome alloy, stainless steel, surgical-grade stainless steel, nickle alloy, titanium and the like. Specifically suitable elastomers include but are not limited to natural rubber, butyl rubber, nitrile rubber, advanced engineering elastomers in either copolymer or homopolymer form, and the like. Specifically suitable plastics include polyethylene, polypropylene, ABS, PVC, engineered performance resins and the like.

Methods of fabrication of insert 24 include but are not limited to, forging, casting, molding, stamping, machining. Specifically suitable types of molding processes include metal molding, thixotropic metal molding, metal injection molding (MIM), powder injection molding (PIM), plastic injection molding, reaction injection molding, insert molding and any other suitable molding process, including advanced or future engineered molding processes, that can result in fabrication of one or more elements of this invention.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. An apparatus for rotating a shaft of at least one of an arrow shaft or a bolt shaft during a flight, the apparatus comprising:

an element mountable in a fixed position with respect to the shaft, the element comprising a female receiver including an inner diameter that is less than an outer diameter of the shaft; and at least one airflow resistor projecting outward from the element and including a lateral surface inclined or declined toward a forward end of the element, wherein the element is mountable at a forward end of the shaft and the female receiver accepts an arrowhead.

2. An apparatus according to claim 1, wherein the element is detachably mountable with respect to the shaft.

3. An apparatus according to claim 1, wherein the female receiver forms a closed bore.

4. An apparatus according to claim 1, wherein the female receiver forms a through bore.

5. An apparatus according to claim 1, wherein the element comprises a body including the female receiver and the at least one airflow resistor is connected to the body.

6. An apparatus according to claim 5, wherein a body outer diameter of the body is approximately equal to a shaft outer diameter of the shaft.

7. An apparatus according to claim 1, wherein the at least one airflow resistor is an airfoil.

8. An apparatus according to claim 7, wherein the airfoil is positioned at an angle with respect to a direction approximately parallel to a longitudinal axis of the shaft.

9. An apparatus according to claim 1, wherein a plurality of the airflow resistors are equally spaced about a periphery of the element.

10. The apparatus of claim 1, wherein the element is fabricated by at least one of forging, casting, molding, stamping, machining, thixotropic metal molding, metal injection molding, powder injection molding, plastic injection molding, reaction injection molding and insert molding.

11. An apparatus according to claim 1, wherein the airflow resistor projects from the element to an outer airflow resistor diameter and the outer airflow resistor diameter is less than an outer broadhead diameter of a broadhead connected to the shaft.

12. An apparatus according to claim 1, wherein the at least one airflow resistor has a height that is less than an outer diameter of the shaft.

13. The apparatus of claim 1, wherein the at least one airflow resistor comprises a helical flight.

14. An apparatus for rotating a shaft of at least one of an arrow shaft or a bolt shaft during a flight, the apparatus comprising:

an element mountable in a fixed position with respect to the shaft, the element comprising a female receiver including an inner diameter that is less than an outer diameter of the shaft: and at least one airflow resistor projecting outward from the element and including a lateral surface inclined or declined toward a forward end of the element, wherein the element is mountable at a rearward end of the shaft.

15. The apparatus of claim 14, wherein the at least one airflow resistor comprises a helical flight.

16. An apparatus for rotating a shaft of at least one of an arrow shaft or a bolt shaft during a flight, the apparatus comprising:

an element mountable in a fixed position with respect to the shaft, the element comprising a female receiver including an inner diameter that is less than an outer diameter of the shaft; and at least one airflow resistor projecting outward from the element and including a lateral surface inclined or declined toward a forward end of the element, wherein the element is mountable between a forward end of the shaft and a reward end of the shaft.

17. An apparatus according to claim 16 wherein the arrow shaft or a bolt shaft extends between an arrow head and a nock, more than one vane is attached to the shaft at an end toward the nock, and the element is mountable between the forward end and the more than one vane.

18. The apparatus of claim 16, wherein the at least one airflow resistor comprises a helical flight.

19. An apparatus for rotating a shaft of at least one of an arrow shaft or a bolt shaft during a flight, the apparatus comprising:

an element mountable in a fixed position with respect to the shaft, the element comprising a female receiver including an inner diameter that is less than an outer diameter of the shaft, wherein the element has a shaft portion that is engageable with a shaft receiver of the shaft and the female receiver accepts one of an arrowhead or a nock; and at least one airflow resistor projecting outward from the element and including a lateral surface inclined or declined toward a forward end of the element.

20. An apparatus according to claim 19, wherein the at least one shaft portion has a shaft portion outer diameter less than a body outer diameter of a body of the element.

21. An apparatus of claim 19, wherein the at least one airflow resistor comprises a helical flight.

22. An apparatus for rotating a shaft of at least one of an arrow shaft or a bolt shaft during a flight, the apparatus comprising:

at least one of an insert or a sleeve mountable in a fixed position with respect to the shaft, the at least one of the insert or the sleeve comprising a body including a female receiver;

at least one airflow resistor projecting outward from and connected to the body, at least a portion of the at least one airflow resistor including a lateral surface inclined or declined toward a forward end of the insert or the sleeve to impart rotational spin to the arrow shaft or bolt shaft; and a body outer diameter of the body approximately equal to a shaft outer diameter of the shaft, or an inner diameter of the female receiver less than or approximately equal to the shaft outer diameter of the shaft.

23. The apparatus of claim 22, wherein the at least one airflow resistor forms a helical flight.

24. The apparatus of claim 22, wherein the body is formed of a stretchable or shrinkable material.

25. An apparatus for rotating a shaft of at least one of an arrow shaft or a bolt shaft during a flight, the apparatus comprising:

at least one of an insert or a sleeve mountable in a fixed position with respect to the shaft, the at least one of the insert or the sleeve comprising a body including a female receiver;

at least one airflow resistor projecting outward from and connected to the body, wherein the at least one airflow resistor forms a helical flight or an airfoil; and a body outer diameter of the body approximately equal to a shaft outer diameter of the shaft, or an inner diameter of the female receiver less than or approximately equal to the shaft outer diameter of the shaft.

* * * * *